US007183522B2

(12) United States Patent
Irrera et al.

(10) Patent No.: US 7,183,522 B2
(45) Date of Patent: Feb. 27, 2007

(54) CORRUGATED ELECTRIC HEATING ELEMENT AND RELATED RADIANT HOTPLATE

(75) Inventors: Angelo Irrera, San Vendemiano (IT); Roberto Sanson, San Vendemiano (IT); Duilio Capraro, Conegliano (IT); Andrea Virzi, Treviso (IT)

(73) Assignee: IRCA S.p.A., San Vendemiano (IT)

( * ) Notice: Subject to any disclaimer, the term of this patent is extended or adjusted under 35 U.S.C. 154(b) by 0 days.

(21) Appl. No.: 10/495,972

(22) PCT Filed: Oct. 15, 2002

(86) PCT No.: PCT/EP02/11495

§ 371 (c)(1),
(2), (4) Date: Aug. 22, 2005

(87) PCT Pub. No.: WO03/045112

PCT Pub. Date: May 30, 2003

(65) Prior Publication Data

US 2006/0151472 A1 Jul. 13, 2006

(30) Foreign Application Priority Data

Nov. 19, 2001 (IT) ..... PN20010045 U

(51) Int. Cl.
*H01B 3/68* (2006.01)
*H01C 3/00* (2006.01)

(52) U.S. Cl. ..... 219/461.1; 219/460.1; 338/279

(58) Field of Classification Search .. 219/443.1–468.2, 219/544–548; 338/279–285
See application file for complete search history.

(56) References Cited

U.S. PATENT DOCUMENTS 4,161,648 A * 7/1979 Goessler ..... 219/461.1
5,477,031 A * 12/1995 McWilliams ..... 219/461.1
5,753,892 A 5/1998 Gross et al.
5,796,075 A * 8/1998 Gross et al. ..... 219/448.19
5,837,975 A 11/1998 Dillard et al.
6,207,935 B1 3/2001 Dittmar et al.

FOREIGN PATENT DOCUMENTS

EP 0625865 A2 11/1994

* cited by examiner

*Primary Examiner*—Sang Paik
(74) *Attorney, Agent, or Firm*—Wenderoth, Lind & Ponack, L.L.P.

(57) ABSTRACT

An electric radiant hotplate includes a base of electrically insulating material and a peripheral crown extending along the outer rim of the base and projecting upwards. A strip of resistive material is inserted in the base and is formed by a sequence of planar lengths and curved lengths connected to respective planar appendices that are inserted in the insulating base. The appendices can be connected to the planar lengths by respective peduncles applied on to the same side edge of the flat strip of resistive material. The appendices can also be either coplanar or not coplanar to the planar lengths and include a first portion connected to the respective planar length of the strip, and at least a second planar portion that is not coplanar with the first portion and is joined to the first portion via a rectilinear border, the first portions being applied on a same side edge of the flat strip of resistive material.

18 Claims, 14 Drawing Sheets

FIG. 13A
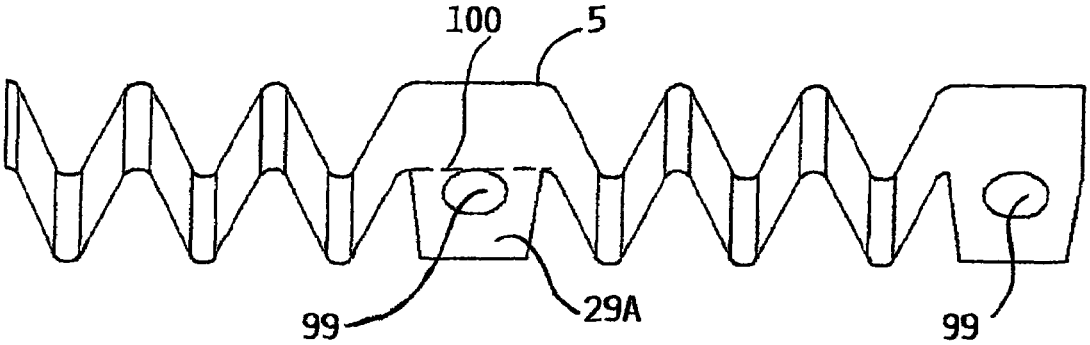
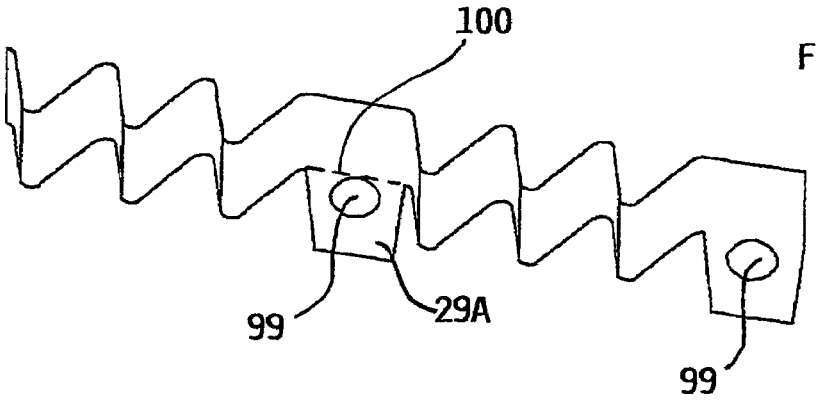
FIG. 13B
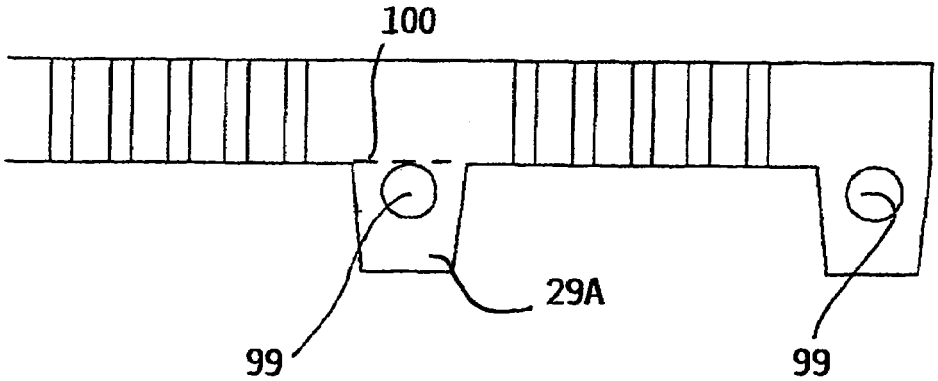
FIG. 13C

CORRUGATED ELECTRIC HEATING ELEMENT AND RELATED RADIANT HOTPLATE

DESCRIPTION

The present invention relates to an electric heating element of the radiant type, as used in particular, although not solely, in electric cooking tops.

More specifically, the present invention refers to an electric heating element in the shape of an elongated strip of an electrically resistive material, such as metals or special alloys thereof, which is arranged upon or partially inserted in a base of electrically insulating and thermally insulating (refractory) material, and is secured to the base by means of appropriate fastening means.

The present invention also relates to a heating plate, or hotplate, in particular of the type used in household cooking tops provided with an upper smooth glass-ceramic surface, equipped with a radiant heating element according to the present invention.

As far as the prior art is concerned, along with the related drawbacks and particular features, this is described in the Italian patent application no. PN2001U000016 filed by this same Applicant, to which reference should therefore be made for reasons of brevity.

The above cited document describes a coiled heating element that is secured in various manners to the related base of insulating material; the technical solution proposed in the patent application has proven particularly advantageous in view of the easiness and inexpensiveness ensured by it in both manufacturing the resistive strip and applying it to the radiant hotplate. However, it has also turned up some drawbacks connected with the heat distortion effect that is brought about by the temperature difference that comes to exist between the zones inside or close to the insulating base and the zones outside or far therefrom. Such a problem may even cause the heating element to partially slip out of the recesses in the base in which it is inserted, under easily imaginable negative consequences from both a functional and an aesthetical point of view.

SUMMARY OF THE INVENTION

Based on the foregoing considerations, it therefore is a purpose of the present invention to provide a kind of electric heating element of the radiant type, which makes use of a corrugated resistive strip provided with straight attachment pins, and which enables the radiating surface to be maximized while doing away with the above cited heat distortion drawbacks and the mechanical stresses associated therewith.

These aims, along with further features of the present invention, are reached in radiant-type electric heating elements of the kind made and operating in accordance with the characteristics recited in the appended claims.

BRIEF DESCRIPTION OF THE DRAWINGS

The present invention can be implemented according to a preferred, however not sole embodiment thereof, which will be described in detail and illustrated below by mere way of non-limiting example with reference to the accompanying drawings, in which:

FIGS. 13A, 13B and 13C are a top inclined view, a perspective view and a vertical plane view, respectively, of a particularly advantageous embodiment of a resistive strip according to the present invention.

DETAILED DESCRIPTION OF THE INVENTION

With reference to the figures, a radiant-type hotplate according to the present invention substantially comprises:

- a base of thermally and electrically insulating material 1,
- a circular crown 3 which is provided on the circular rim of the base and projects upwards so as to define an approximately cylindrical space delimited between the base and the circular crown, in which the circular crown is preferably made of the same material used to make the base, and
- one or more radiant electric heating elements 5 positioned within the approximately cylindrical space.

According to the present invention, the electric heating elements 5 are obtained out of an elongated flat strip, as it will referred to hereinafter, of an electrically resistive material, preferably a metal or alloys thereof.

The flat strip of resistive material is shaped in a corrugated or a saw-toothed manner according to different patterns or variants, which, however, share in all cases the feature according to which the two opposite edges of the strip are so shaped as to come to lie on two distinct respective planes, the two planes being parallel to each other.

A further basic feature shared by all the above mentioned possible variants in the shaping of the strip is given by the fact that such a strip is formed by a sequence of planar (flat) lengths and curved lengths, in which the different lengths are mutually alternated, and in which the curved lengths are curved either in a sharp manner, so as to confer a saw-toothed profile to the strip, or with a more smooth, continuous curvature along a short length of the flat strip.

Furthermore, at least some of the planar lengths are connected to respective appendices that are at least partially inserted in the base of insulating material 1, in which the appendices are connected to a same edge of the respective flat strip.

Figure 2B:
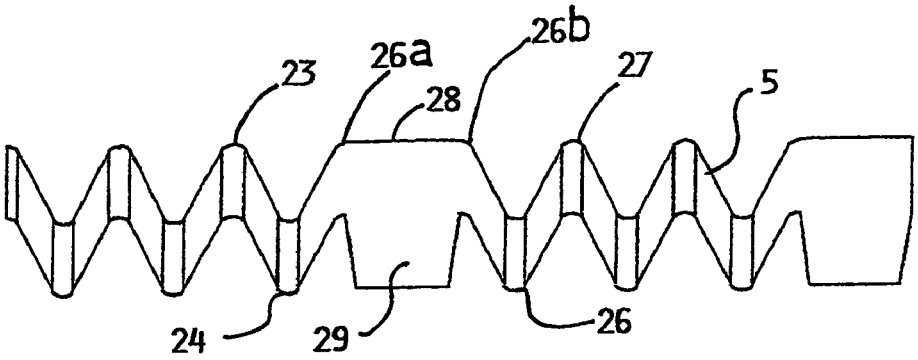
FIGS. 2A, 2B and 2C are views from the top, in a front projection inclined from the top, and in the state in which it is inserted in the insulating base, respectively, of a first embodiment of a heating element according to the present invention.
Figure 2A:
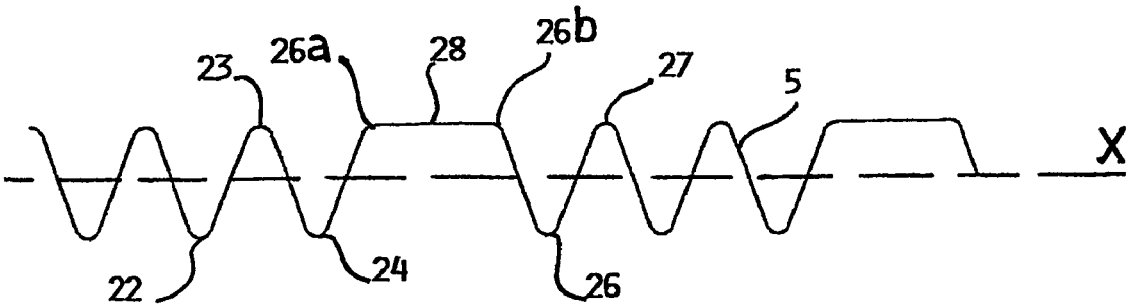
Figure 2C:
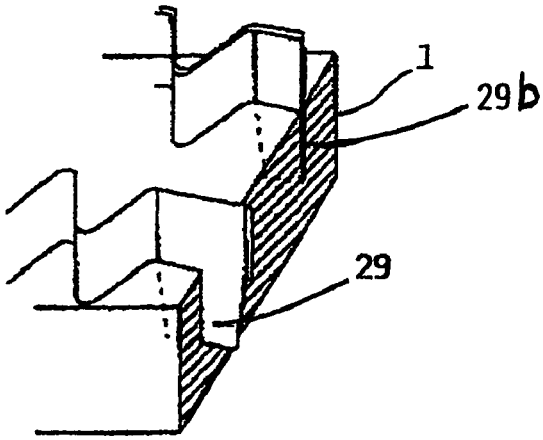

With reference to the figures, these can be noticed to represent some embodiments of the resistive flat strip according to the present invention. In particular, it can be noticed that FIGS. 2A, 2B and 2C illustrate a flat strip 5 which is formed with a saw-toothed pattern with a plurality of alternate tips 22, 23, 24, 26, 27. According to the present invention, between two tips 24, 26 oriented in the same direction there are arranged two tips 26*a* and 26*b* that are bent to a lesser extent by such an angle that an intermediate planar length 28 lying therebetween is a planar length preferably parallel to the direction X of extension of the flat strip 5, and anyway orthogonal to the two parallel planes containing the opposite edges of the flat resistive strip.

According to the present invention, the planar length 28 is provided with a planar anchorage appendix 29, which is coplanar with the planar length 28 and is adapted to engage the base 1 by being inserted therein, as this is illustrated in FIG. 2C that shows two illustrations of the appendix 29, one of which, appendix 29, is partially sectioned according to the same plane of section as the base 1 and the other one, the appendix 29, is protruding form the same plane of section.

Figure 3C:
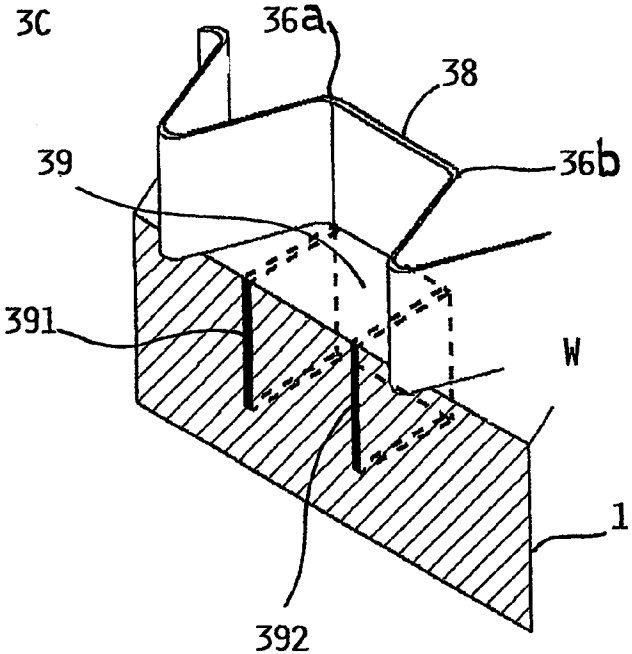
FIGS. 3A, 3B and 3C are top views in axonometric projection, and in the state in which it is inserted in the insulating base, respectively, of a second embodiment of a heating element according to the present invention.
Figure 3A:
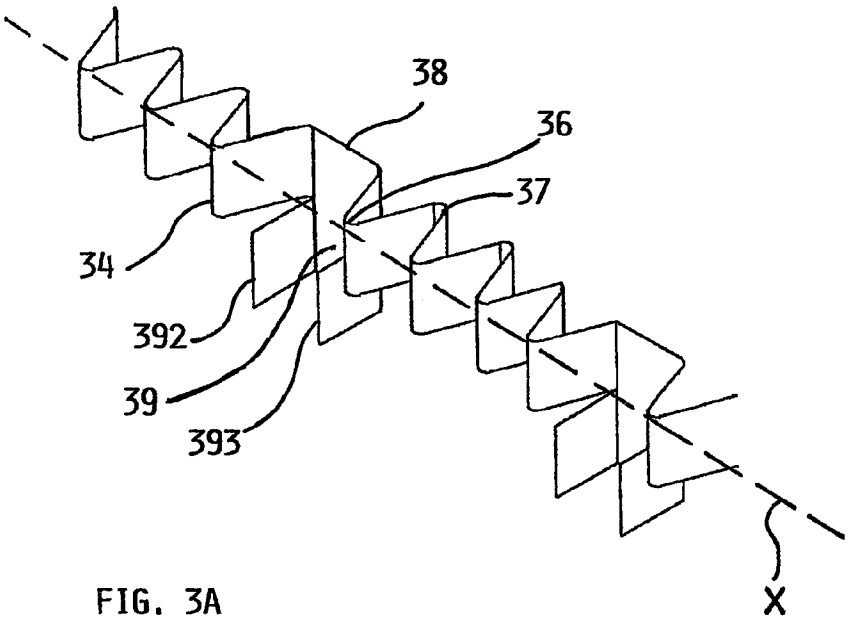
Figure 3B:
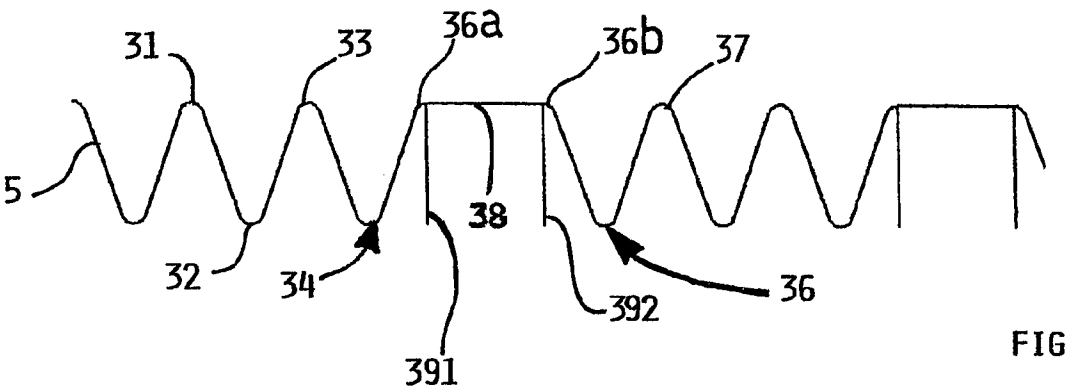

A different embodiment is illustrated in FIGS. 3A, 3B and 3C, in which the flat strip 5 is shaped to a saw-toothed configuration with a plurality of alternate tips 31, 32, 33, 34, 36, 37. According to the present invention, between two tips oriented in the same direction 34, 36 there are arranged two tips 36*a* and 36*b* that are bent to a lesser extent and by such an angle that the intermediate planar length 38 lying therebetween is a planar length aligned parallel to the direction X of extension of the flat strip 5. Also according to the present invention, the planar length 38 is provided with a planar appendix 39, which is coplanar with the planar length 38 and is adapted to engage the base 1 by being inserted therein, as illustrated in FIG. 3C. As compared with the aforementioned embodiment, this solution can be noticed to show the planar appendix 39 being, in turn, provided with two further auxiliary planar appendices 391 and 392 located at the opposite vertical edges thereof and oriented in a manner so as to be non-coplanar with the respective planar appendix 39. Furthermore, the two further planar appendices 391 and 392 are arranged along planes that are orthogonal to the upper planar surface W of the insulating base 1, so that the pressure of the flat strip 5 against the base does not only cause the first appendix 39 to penetrate, but also the two planar appendices 391 and 392 to be at the same time inserted edgeways in the base 1.

Figure 4C:
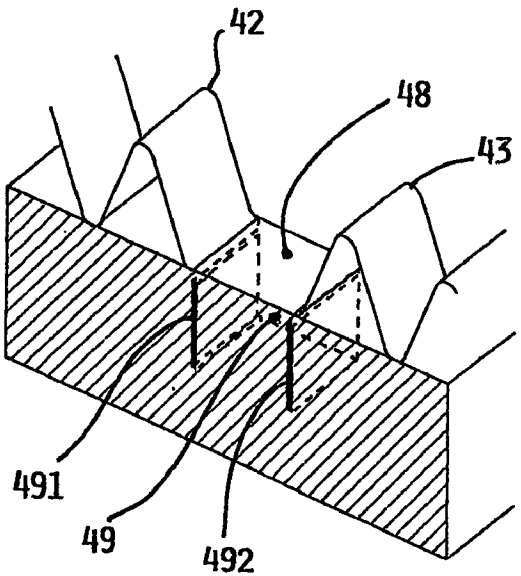
FIGS. 4A, 4B and 4C are side views, in axonometric projection and in the state in which it is inserted in the insulating base, respectively, of a third embodiment of a heating element according to the present invention.
Figure 4A:
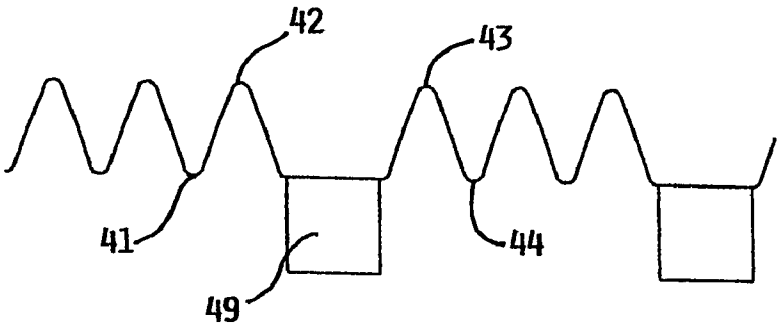
Figure 4B:
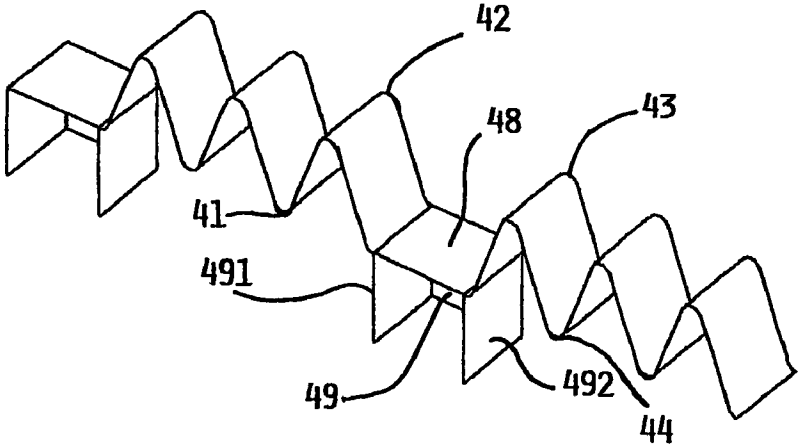

A third embodiment is illustrated in FIGS. 4A, 4B and 4C. According to such a solution, use is basically made of a flat resistive strip that is only partly similar to the one described in connection with the above illustrated embodiment, since the same strip undergoes, in this case, some modifications, as far as its implementation and assembly arrangement on the base 1 are concerned, in the following manner. With regard to the form of implementation thereof, the respective planar length 48 is provided with a planar appendix 49, which, however, is no longer coplanar with the planar length 48, but is rather oriented at a right angle with respect thereto and arranged in the zone opposite to the tips 42, 43 of the flat strip, which lie on the opposite sides of the planar length 48.

Similarly to the aforementioned case, this solution can be noticed to show the planar appendix 49 being, in turn, provided with two further side planar appendices 491 and 492 located at the opposite free edges thereof and oriented in a manner so as to be non-coplanar with, but rather orthogonal to the respective planar appendix 49.

As far as the assembly arrangement thereof is concerned, the resistive strip is mounted in such a manner as to cause the tips to lie in a position that is not orthogonal to the surface of the base 1, but are alternately resting thereupon or are slightly inserted therein, so that the free tips 41 and 44 lie above the surface W of the insulating base 1. In this manner, the respective planar length 48 comes to lie fully parallel to and adhere against the surface of the base 1. Also in this case, both the planar appendix 49 and the two further side appendices 491 and 492 are capable of being inserted edgeways in the base 1.

Preferably, as is shown in FIGS. 4B and 4C, the side appendices 491 and 492 are bent so as to lie exactly under the resistive strip, in such a manner as to cause a niche, as defined by the four walls 48, 49, 491 and 492, to be thereby created.

However, the above illustrated technical solutions, although quite effective and easily implemented, have following drawback in the real practice. Since there are provided both corrugated resistive lengths and planar resistive lengths, the presence of the last mentioned lengths imposes, for a same total power output, a heating element that is "longer" than it would actually be if it were formed by only a single corrugated length. From this fact, the need therefore arises for the flat resistive strip to be wound with a greater number of turns or bends, which would, of course, become too thick, i.e., too closely packed, and this would bring problems with it from both a manufacturing and a functional point of view.

Figure 5A:
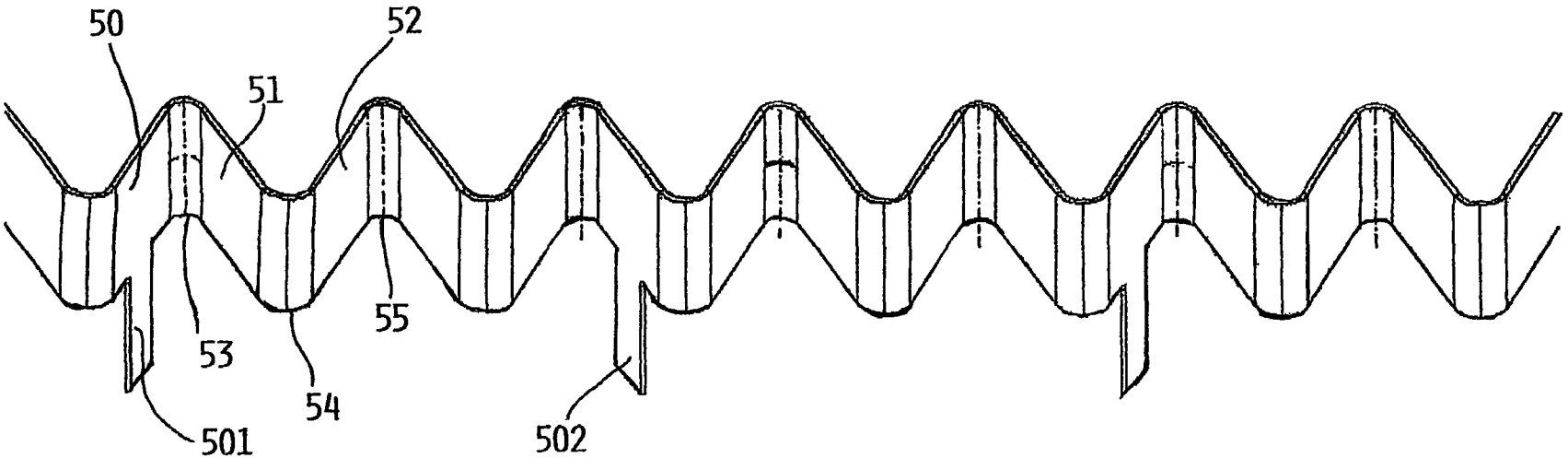
FIGS. 5A, 5B and 5C are respective views of a flat resistive strip, or related enlargement, according to a fourth embodiment of a heating element according to the present invention.

In view of dealing with such a drawback, and with reference to FIGS. 5A through to 5E, it has been found that an advantageous embodiment of the present invention is reached if the planar lengths, to which the planar anchoring appendices are applied, are completely eliminated (which in practice means that the flat resistive strip is formed by a single corrugated length), whereas the anchoring appendices are in this case provided directly on the corrugated or saw-toothed walls that form the flat resistive strip between contiguous tips thereof. However, since one of the basic peculiarities of the present invention lies in the fact that the anchoring appendices are planar, it also ensues that the wall of the flat strip from which they extend must be planar, so that the flat resistive strip ultimately takes a saw-toothed form or a triangular form, with the tips that may maintain an adequately roundish curvature, while the walls between successive tips become strictly planar, under exclusion of any corrugated conformation.

Figure 5B:
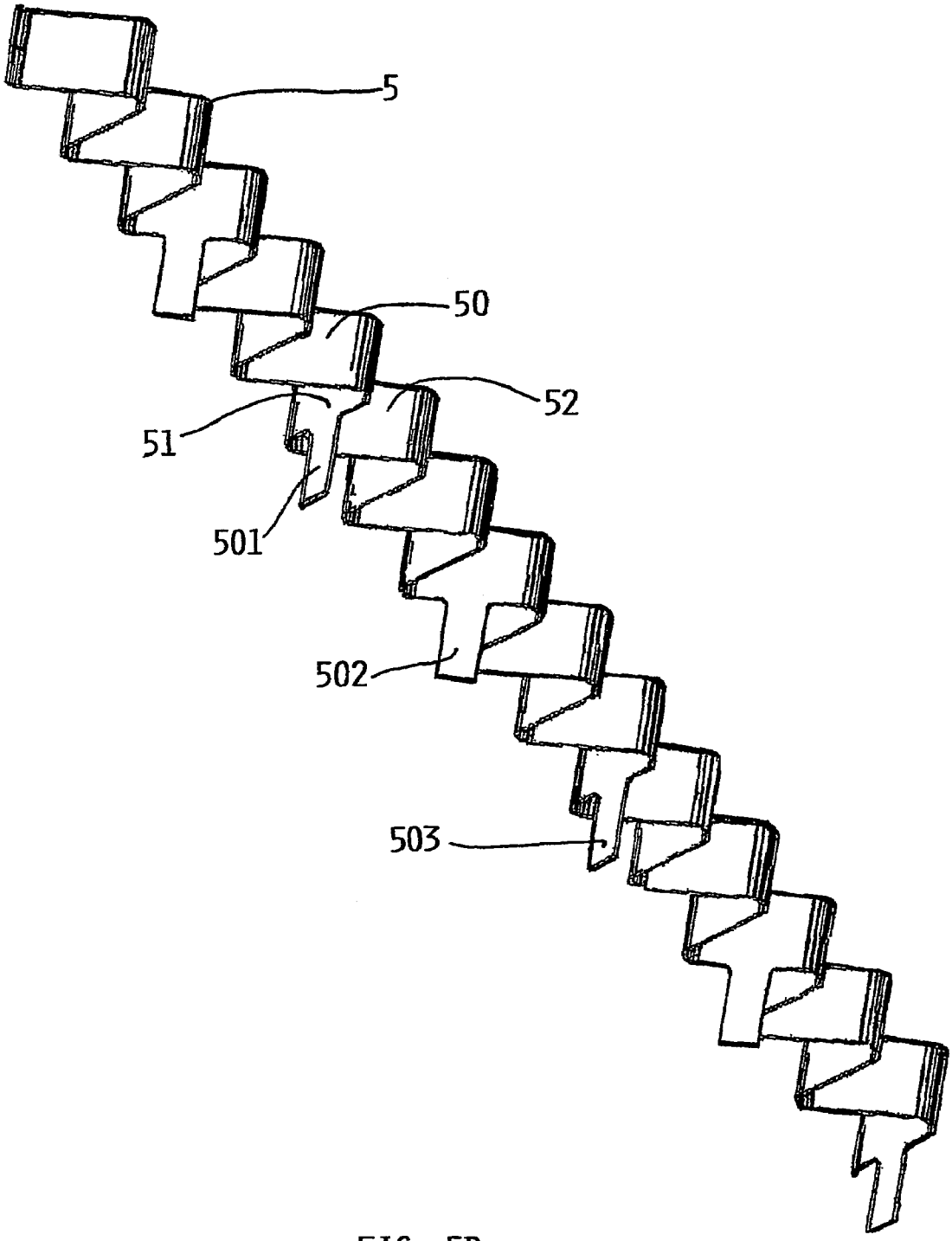
Figure 5C:
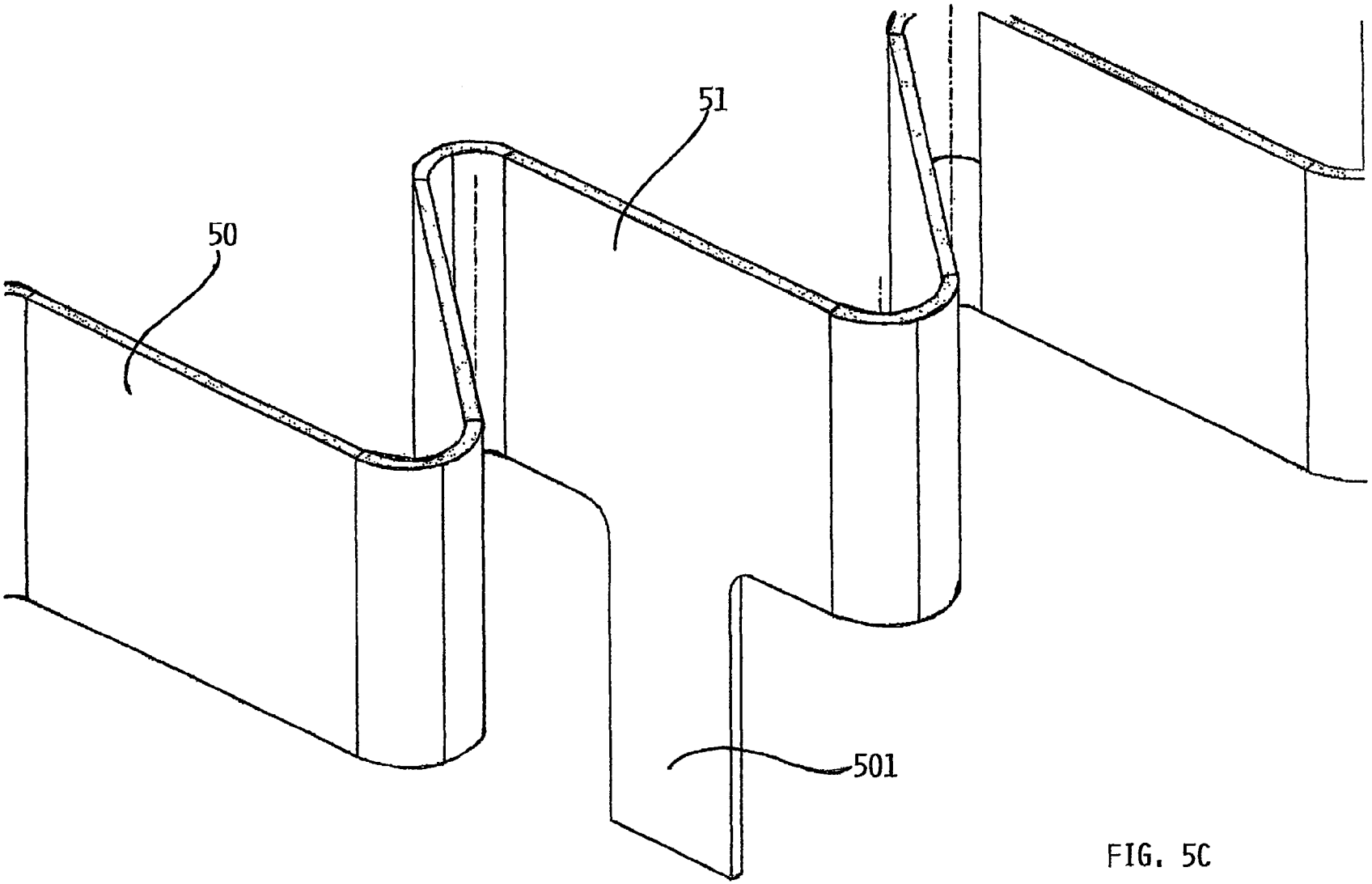

FIGS. 5A, 5B and 5C illustrate a flat resistive strip 5 formed by alternating planar walls 50, 51, 52, etc., with lengths 53, 54, 55 that are curved to a semicircumference, so that the planar walls lie preferably equally long and facing each other. Both the planar walls and the respective curved lengths are orthogonal to the insulating base 1.

In correspondence to the planar walls, and on the same edge facing the insulating base 1, there are applied respective appendices 501, 511, 521, etc., which, similarly to the aforementioned cases, are inserted edgeways into the insulating base, and which ensure the stability of the related flat resistive strip when the latter is applied to the base with the planar lengths 50, 51, 52, etc. arranged orthogonally thereto.

Figure 5E:
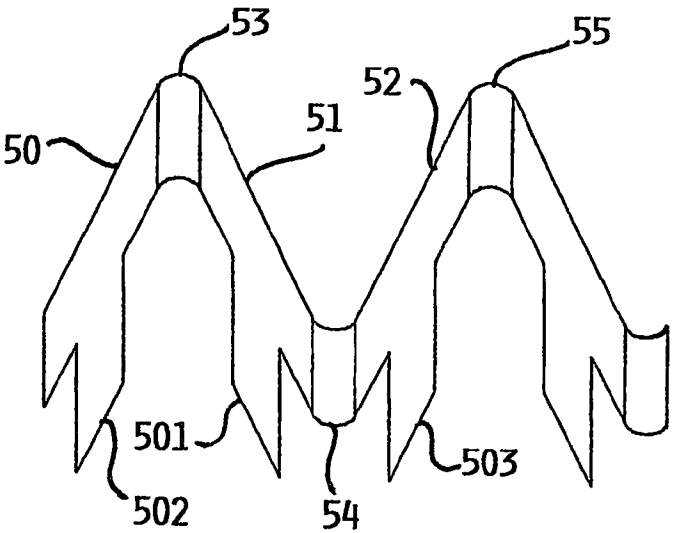
FIGS. 5D and 5E are respective top perspective front and inclined views of a variant of the solutions illustrated in the preceding figures.
Figure 5D:
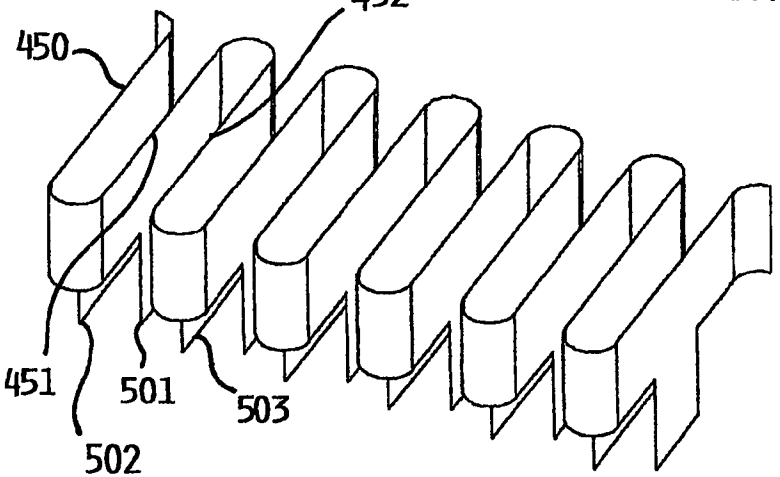

Such a conformation allows for following two variants. The first one of these variants is based on the fact that the anchoring appendices 501, 502, 503 are joined to respective planar walls 50, 51, 52 . . . that follow each other, i.e., are arranged successively with respect to each other, as is best illustrated in FIG. 5E. In the case of the second variant, which is illustrated in FIG. 5D, the planar walls 450, 451, 452, etc. are, on the contrary, parallel to each other, so that also the respective anchoring appendices 501, 502, 503 . . . are of course parallel to each other.

It has, however, been noticed that the aforementioned solutions, based on appendices joined to the flat resistive strip over the whole width of the appendices and, therefore, over rather extended lengths, lead, as an obvious result, to a modification and, more precisely, a reduction in the ohmic resistance in correspondence thereof. Since a rather high current is actually supplied, such a reduction in the electric resistance translates into a corresponding reduction in the power output along the lengths, and this of course leads to the ultimate result of a decay in the overall performance of the hotplate, a much slower temperature rise pattern and also a quicker weardown brought about by the different thermal expansion pattern determined by the different heat outputs occurring along contiguous lengths of the strip.

Figure 6:
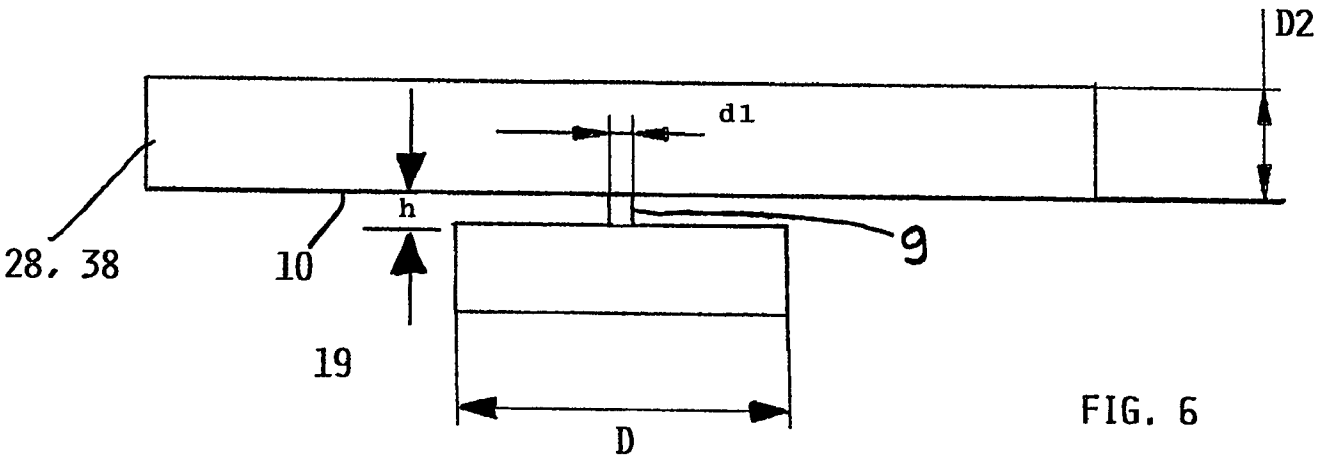
FIG. 6 is a view of a preferred embodiment of a sample piece, or specimen, of a resistive strip according to the present invention.

In order to deal with such drawbacks, and with particular reference to FIG. 6, use is made of appendices 19, made according to and adapted to be engaged in any of the aforementioned manners, which are adapted to be joined to the respective planar lengths 28, 38 by means of respective joining means 9 applied to a same side edge 10 of the flat strip of resistive material, and coplanar with the respective planar length.

The particularity of this invention lies in the fact that the width d1 of the joining means 9, which are preferably constituted by metal links that are punched integrally with the flat resistive strip, is substantially smaller than the length D of the entire appendix, so that the ohmic resistance of the flat resistive strip is not altered to any significant extent, while still ensuring good mechanical securing and holding properties owing to the width of the portion of appendix that is inserted in the insulating base remaining almost the same.

Figure 7:
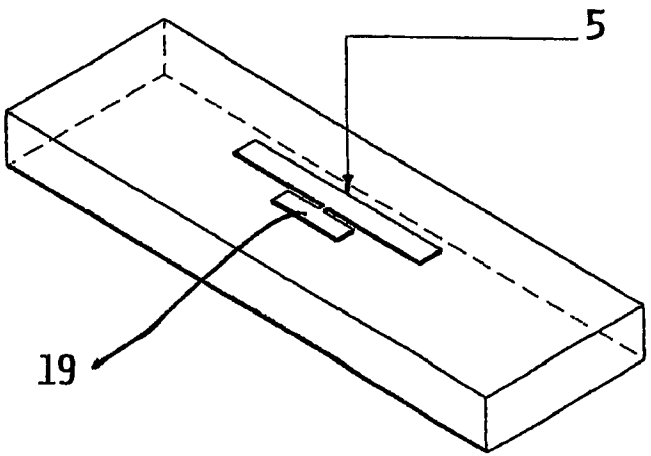
FIG. 7 is a view of the test arrangement used for the specimen of the strip shown in FIG. 6.

In the course of laboratory tests and experiments, which have been carried out by placing the appendix 19 illustrated in FIG. 6 on an electrically and thermally insulating test rig represented in FIG. 7, it has been furthermore observed that an acceptable electric and mechanical result is attained when the ratio of the width D2 of the flat strip to the width d1 of the joining means 9 is at least 3.0.

Figure 8:
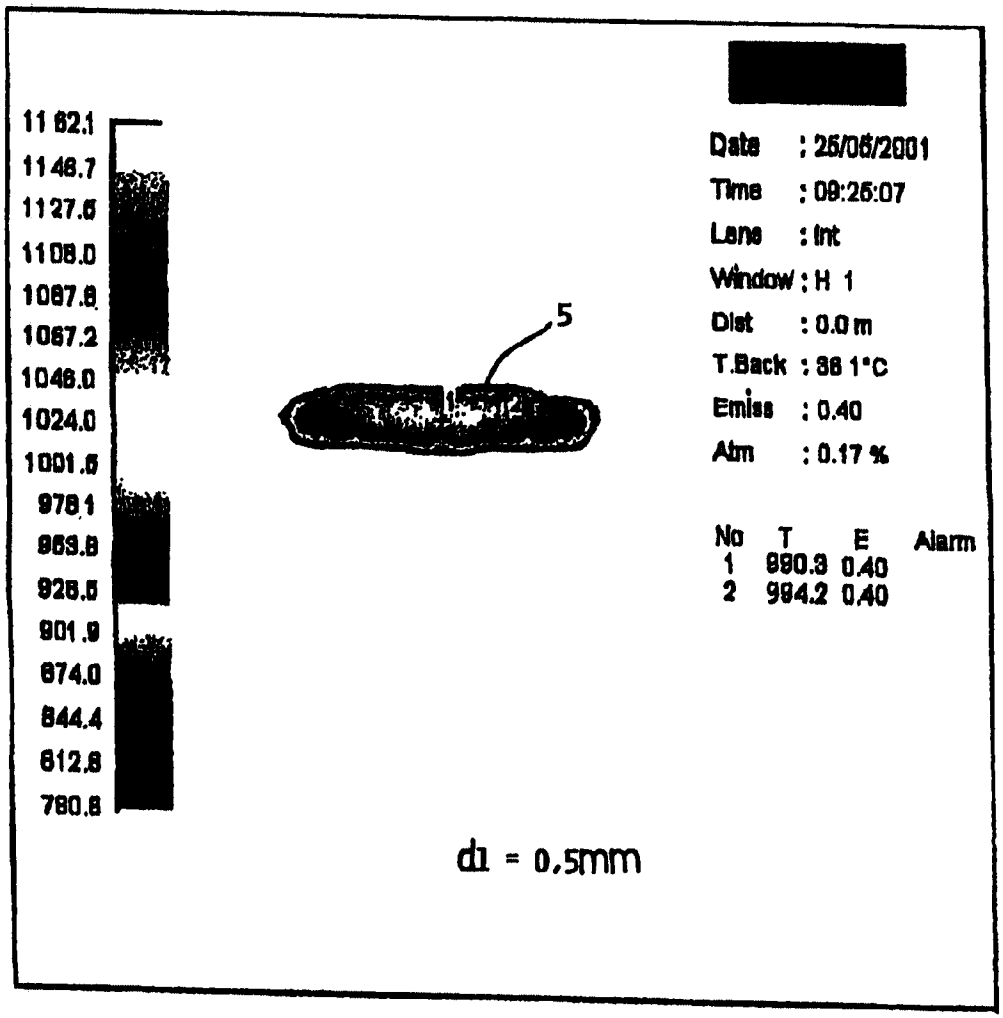
FIGS. 8, 9 and 10 are views of thermographic images of respective specimens of the heating element, as generally illustrated in FIG. 6, with different geometrical parameters.
Figure 9:
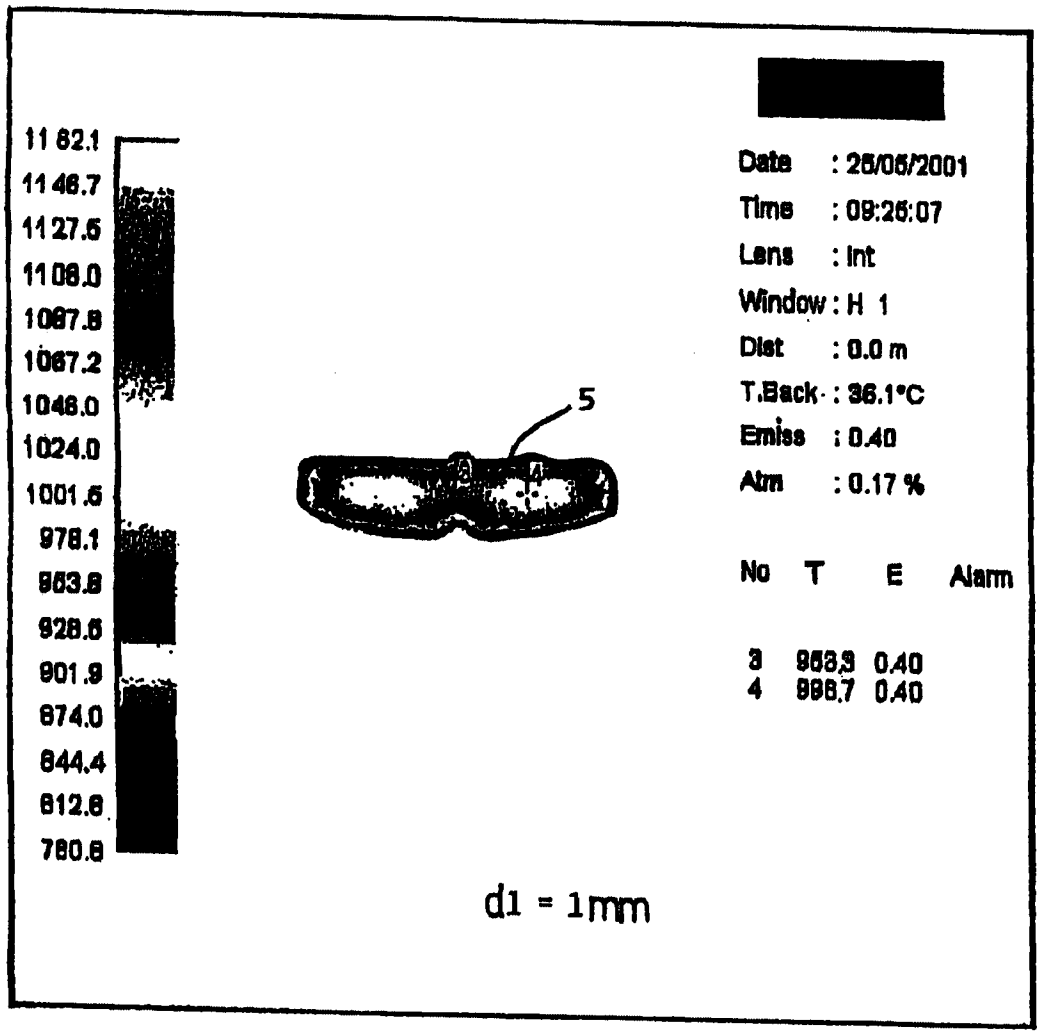
Figure 10:
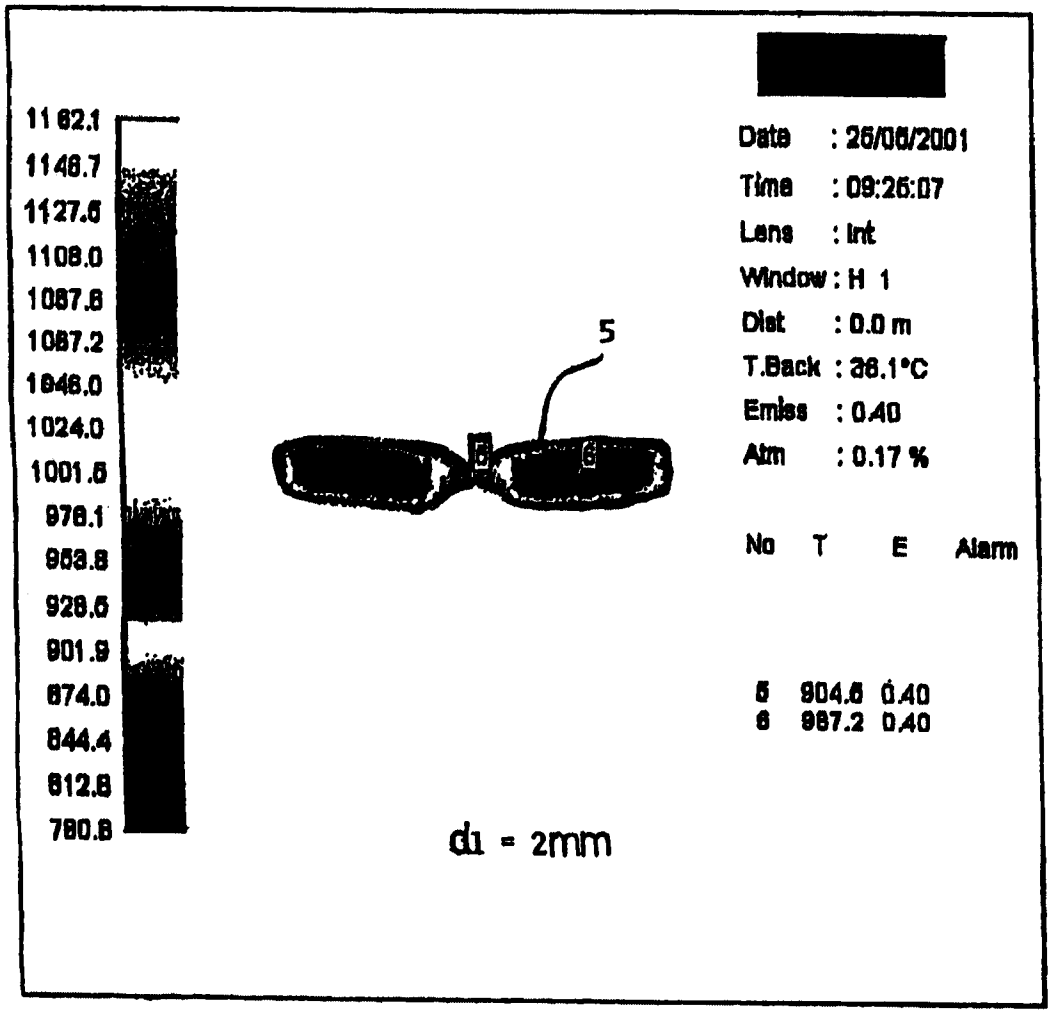

The results of these tests are summarized in the thermographies illustrated in FIGS. 8, 9 and 10, which display the heat output characteristic of the corrugated heating element provided with an appendix as illustrated in FIG. 6 in the three cases in which, with the given dimensions, the width d1 of the joining means is 0.5–1.0–2.0 mm, respectively, and D2 is constant at a width of 4.6 mm.

All other characteristics are specifications of the specimens are similar and, in particular, h=1.2 mm.

From the above cited thermographies, it clearly appears that, with d1=0.5 mm, the thermal behavior of the related lengths of corrugated heating element is not altered to any appreciable extent.

Figure 1:
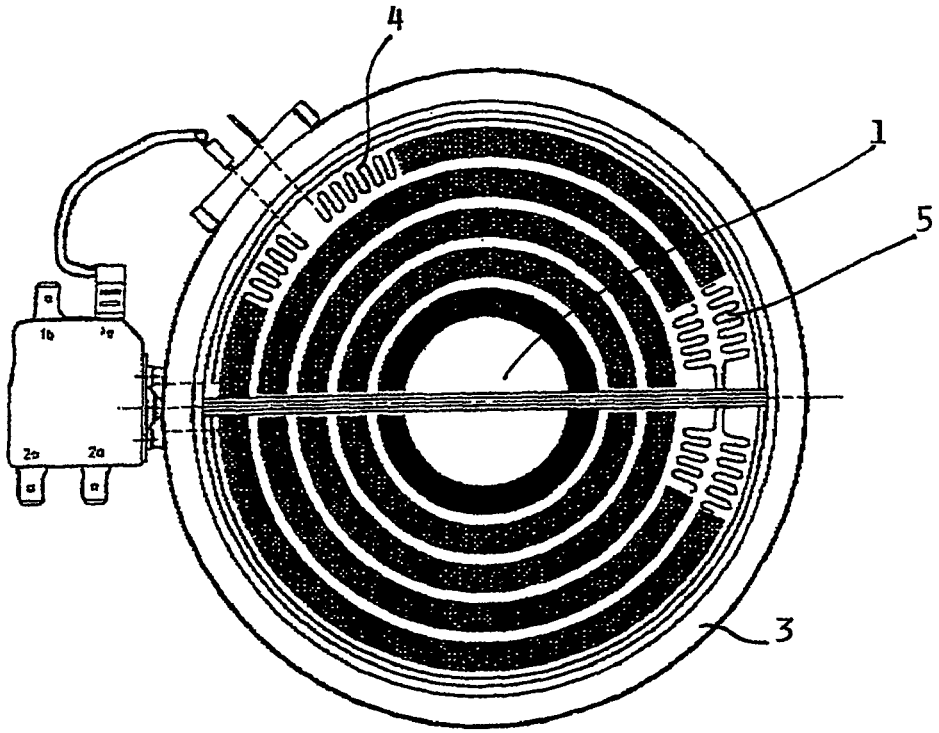
FIG. 1 is a top view of the arrangement of the heating element according to the present invention on a radiant hotplate.
Figure 11:
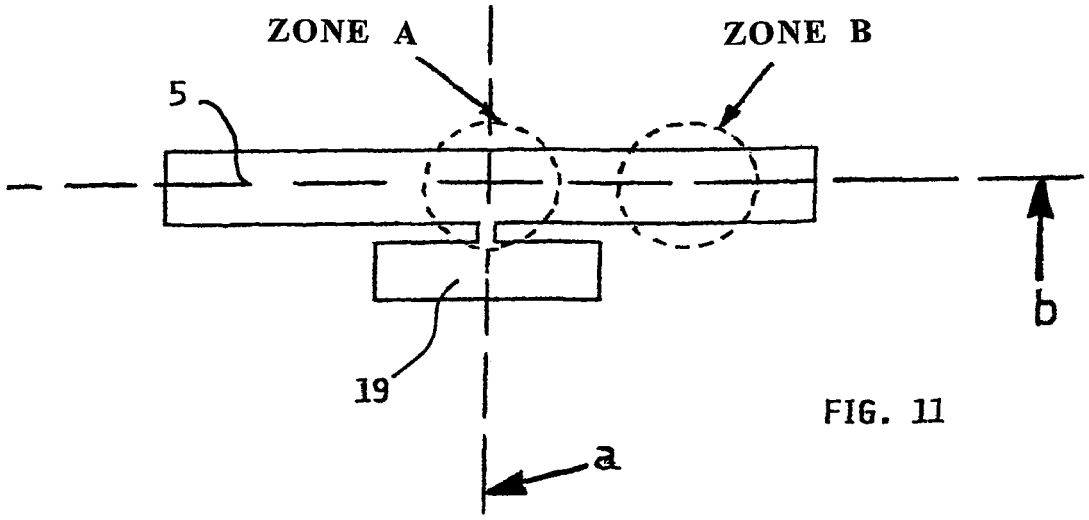
FIGS. 11 and 12 are views of the planar appendix shown in FIG. 6, emphasizing some particular zones of the illustration in FIG. 6, and the related thermal behavior under regular-operation electrical load, respectively.

Such behavior is confirmed by the following measurements described with reference to FIGS. 11 and 12. In FIG. 11, a length of corrugated heating element, provided with an appendix 10 of the illustrated kind, is energized in the regular manner, while generally indicated at A and B there are the two zones that lie close to and far from the appendix, respectively.

Figure 12:
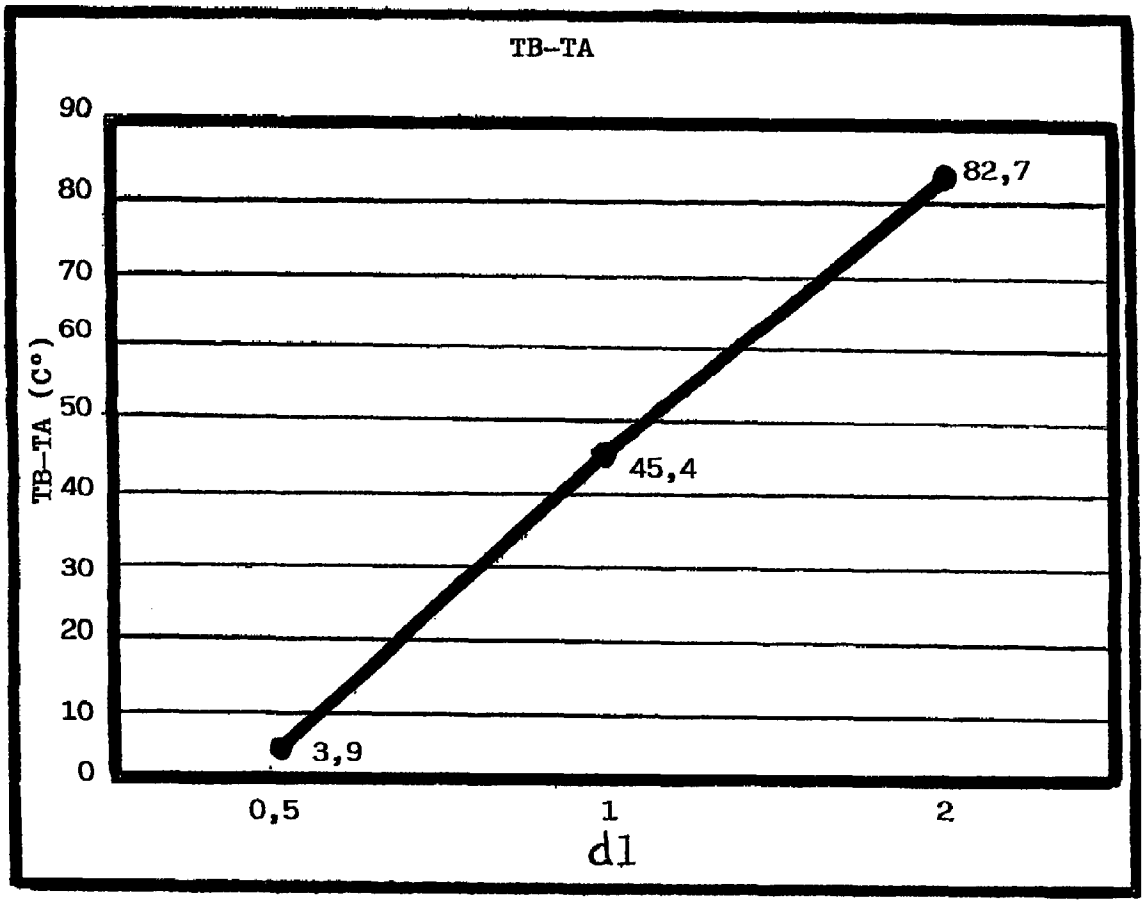

FIG. 12 is a diagram in which the width d1 of the joining means 9 of FIG. 6 is indicated in the abscissa, and the temperature difference TB−TA between the above indicated zones A and B, when the corresponding flat resistive strip is energized so as to have a temperature of approximately 900° C., is indicated in the ordinate.

It fully and clearly appears that, as these joining means become thinner, the temperature difference between the above-mentioned zones progressively decreases down to almost zero, which further demonstrates that the presence of appendices of the herein described kind may not affect the thermal behavior of a corrugated heating element according to the present invention to any extent whatsoever. It should furthermore be noticed that it is preferable if such joining means are formed with a rectangular shape (FIG. 11), in which one of the axes (a) of the resulting rectangles is orthogonal to the axis (b) of the flat resistive strip 5.

It has also been considered that the exiguity of the width of the joining means 9 used to unite the appendix 19 to the flat resistive strip 5 might lead to an undesired weakening thereof. Therefore, in view of doing away with such a risk, the following advantageous variant is proposed. With reference to FIGS. 13A, 13B and 13C, which illustrate a flat resistive strip provided with planar appendices 29A that is generally similar to the flat resistive strip illustrated in FIGS. 2A, 2B and 2C with the respective planar appendices 29, this improvement of the invention consists of providing the planar appendices 29A with at least a through-perforation 99 to reduce the common section 100 between the planar appendix 29A and the corresponding length of the flat resistive strip 5, however, without introducing any unacceptable weakening effect in the connection of such elements to each other.

The advantageous result is thereby attained that the planar appendices 29A, although provided with the perforation 99, constitute neither a weakening factor nor a cause of uncertain securing of the resistive strip 5 to the base of insulating material 1, while the perforations 99 are on the contrary adequate for reducing the width of the common section 100 to a desired extent, so that the electric behavior of the planar appendices 29A and the corresponding lengths of flat resistive strip 5 resembles in an almost indistinguishable and, therefore, advantageous manner the behavior of the appendices of the kind illustrated in FIG. 6.

It will also be readily appreciated that the solution calling for the appropriate perforations 99 to be provided in respective planar appendices can also be favorably applied to all variants and embodiments of the types of planar appendices illustrated in FIGS. 3A through to 5D, which, for reasons of greater simplicity and owing to them being capable of being readily understood by those skilled in the art, shall not be specifically represented here.

The invention claimed is:

1. An electric radiant hotplate comprising:

a base of thermally and electrically insulating material;

a peripheral crown arranged along an outer rim of said base and projecting upwards; and at least one strip of resistive material having a sequence of flat lengths and curved lengths and a plurality of anchoring appendices respectively connected to at least some of said flat lengths, said plurality of anchoring appendices having flat surfaces and being at least partial inserted in said base, wherein said plurality of anchoring appendices are located on a same side edge of said at least one strip, said plurality of anchoring appendices are at least partially parallel with said flat lengths, said at least one strip is positioned such that main surfaces of said at least one strip are orthogonal to said base, and each of said plurality of anchoring appendices has a first portion that is parallel with said respective flat length, and second and third planar portions that are not coplanar with said first portion and are joined to opposite rectilinear edges of said first portion.

2. An electric radiant hotplate according to claim 1 wherein said curved lengths of said at least one strip are each formed by a sequence of planar walls orthogonal to said base jointed to each other by curved tips or cusps, none of said planar walls is parallel to said flat lengths of said at least one strip, at least some of said planar walls have a planar appendix which is coplanar with said respective planar wall, said planar appendices are located on a same side edge of said at least one strip, and none of said planar walls has more than one of said planar appendices.

3. An electric radiant hotplate according to claim 2 wherein said planar walls are parallel to each other.

4. An electric radiant hotplate according to claim 3 wherein said planar walls of each of said curved lengths having said planar appendices follow each other or are contiguous to each other in a sequence.

5. An electric radiant hotplate according to claim 3 wherein said anchoring appendices each have a perforation.

6. An electric radiant hotplate according to claim 4 wherein said anchoring appendices each have a perforation.

7. An electric radiant hotplate according to claim 2 wherein said planar walls of each of said curved lengths having said planar appendices follow each other or are contiguous to each other in a sequence.

8. An electric radiant hotplate according to claim 7 wherein said anchoring appendices each have a perforation.

9. An electric radiant hotplate according to claim 1 further comprising joining means for joining said anchoring appendices to said respective flat lengths, such that said anchoring appendices are located on a same side edge of said at least one strip and coplanar with said respective flat lengths.

10. An electric radiant hotplate according to claim 9 wherein a ratio of a width of said at least one strip to a width of each of said joining means is at least 3.0.

11. An electric radiant hotplate according to claim 9 wherein said joining means have a rectangular shape, whereby an axis of each of said joining means is orthogonal to an axis of said at least one strip.

12. An electric radiant hotplate according to claim 10 wherein said joining means have a rectangular shape, whereby an axis of each of said joining means is orthogonal to an axis of said at least one strip.

13. An electric radiant hotplate according to claim 9 wherein said anchoring appendices each have a perforation.

14. An electric radiant hotplate according to claim 2 wherein perforations are located near a common section between said anchoring appendices and said corresponding flat lengths of said at least one strip of resistive material.

15. An electric radiant hotplate according to claim 2 wherein said anchoring appendices each have a perforation.

16. An electric radiant hotplate according to claim 1 wherein said anchoring appendices each have a perforation.

17. An electric radiant hotplate comprising:

a base of thermally and electrically insulating material;

a peripheral crown arranged along an outer rim of said base and projecting upwards; and at least one strip of resistive material having a sequence of flat lengths and curved lengths and a plurality of anchoring appendices respectively connected to at least some of said flat lengths, said plurality of anchoring appendices having flat surfaces and being at least partial inserted in said base, wherein said plurality of anchoring appendices are located on a same side edge of said at least one strip, said plurality of anchoring appendices are at least partially parallel with said planar lengths, said at least one strip is positioned such that said flat lengths are parallel and adjacent to said base, each of said plurality of anchoring appendices has a first portion that is not parallel with said respective flat length and is orthogonal thereto, and second and third planar portions that are not coplanar said first portion nor said respective flat length, and are joined to opposite rectilinear edges of said first portion.

18. An electric radiant hotplate according to claim 17 wherein said anchoring appendices each have a perforation.

* * * * *